United States Patent [19]

Hisajima et al.

[11] Patent Number: 4,523,754

[45] Date of Patent: Jun. 18, 1985

[54] PAPER GUIDING DEVICE IN A COPYING APPARATUS

[75] Inventors: Masahiko Hisajima, Osaka; Hiroshi Kimura, Habikino; Yutaka Shigemura, Takarazuka; Isao Yada, Neyagawa; Yoichiro Irie, Suita; Kiyoshi Morimoto, Osaka; Takashi Nagashima, Neyagawa, all of Japan

[73] Assignee: Mita Industrial Co., Ltd., Japan

[21] Appl. No.: 554,644

[22] Filed: Nov. 23, 1983

Related U.S. Application Data

[62] Division of Ser. No. 349,544, Feb. 17, 1982.

[30] Foreign Application Priority Data

Mar. 2, 1981 [JP] Japan ..... 56-28445
Mar. 10, 1981 [JP] Japan ..... 56-32265[U]
Mar. 10, 1981 [JP] Japan ..... 56-32266[U]

[51] Int. Cl.[3] ..... B65H 5/38

[52] U.S. Cl. ..... 271/264; 432/77; 165/47; 34/66; 355/3 SH

[58] Field of Search ..... 271/264, 314; 432/228, 432/77; 34/66, 67, 155; 355/14 SH, 3 SH; 165/47

[56] References Cited

U.S. PATENT DOCUMENTS 1,225,743 5/1917 Barber ..... 271/314
3,849,907 11/1974 Lynch ..... 34/155
3,914,097 10/1975 Wurl ..... 34/66
4,372,668 2/1983 Malachowski et al. ..... 271/114

FOREIGN PATENT DOCUMENTS 26747 2/1983 Japan ..... 271/264

*Primary Examiner*—Bruce H. Stoner, Jr.
*Assistant Examiner*—James E. Barlow
*Attorney, Agent, or Firm*—Beveridge, De Grandi & Weilacher

[57] ABSTRACT

A paper guiding device in a copying apparatus includes, in opposition, a lower guide plate having a main flat portion and an upper guide plate having a main flat portion. A plurality of rising pieces, having top edges and being laterally spaced apart upon the upper side of the main flat portion of the lower guide plate, rise above the lower guide plate and extend in the direction of movement of the copying paper. A plurality of hanging pieces, having lower edges and are laterally spaced apart on the lower side of the main flat portion of the lower guide plate, hang from the upper guide plate and extend in the direction of movement of the copying paper. The top edges and the lower edges define a path of movement of the copying paper while having minimal contact with the paper. A plurality of openings through the upper guide plate and an opening through each of the hanging pieces dissipate heat from the copying paper to substantially prevent the accumulation of moisture on the copying paper and in the improved paper guiding device.

3 Claims, 4 Drawing Figures

PAPER GUIDING DEVICE IN A COPYING APPARATUS

This is a division of application Ser. No. 349,544, filed Feb. 17, 1982.

FIELD OF THE INVENTION

This invention relates to a copying paper feeding device and a copying paper guiding device in a copying machine.

DESCRIPTION OF THE PRIOR ART

It is known to those skilled in the art, that in an electrostatic copying apparatus of the toner image transfer type, a sheet-like copying paper conveyed through a paper conveying passage has a toner image transferred thereon in a transfer zone, which image is then heat-fixed by a heat fixing device comprised of, for example, a pair of fixing rollers at least one of which is heated, and thereafter is discharged out of the housing of the copying apparatus while being guided by a paper guiding device. As such a paper guiding device, there is widely used a device of the type including a lower guide plate and an upper guide plate located opposite to each other and defining a paper moving passage therebetween.

This type of know paper guiding device, however, has an important problem to be solved. Specifically, since the copying paper is heated to a considerably high temperature in the heat fixing device, the copying paper which is to enter the paper guiding device from the heat fixing device is kept at a considerably high temperature. When the paper at such a high temperature is introduced into the paper moving passage of the guiding device between the upper and lower guide plates, the space between the lower and upper guide plates is heated by the heat dissipated from the copying paper, and consequently, dew tend to form on the upper side of the lower guide plate and the lower side of the upper guide plate. The dew formed may adhere to the paper advancing through the guide means, and the paper itself and the toner image formed on it are likely to be deteriorated. Moreover, the smooth movement of the paper may be hampered, and paper jamming is likely to occur.

SUMMARY OF THE INVENTION

An object of this invention is to provide a paper guiding device which gives an ingenious solution to the aforesaid problems residing in the known paper guiding devices.

With regard to the object, the present invention provides a copying paper guiding device including a lower guide plate and an upper guide plate located opposite to each other, characterized in that the lower guide plate has provided therein laterally in spaced-apart relationship a plurality of rising pieces rising from the upper side of its main flat portion and extending in the direction of movement of a copying paper, the upper guide plate has provided therein laterally in spaced-apart relationship a plurality of hanging pieces hanging from the lower side of its main flat portion and extending in said direction of paper movement, the upper edges of the rising pieces cooperate with the lower edges of the hanging pieces to define a path of movement of the copying paper, and that openings are formed on the main flat portion of said upper guide plate.

DETAILED DESCRIPTION OF THE INVENTION

There will now be described the paper guiding device of the invention for guiding a paper conveyed through the conveying passage, which is especially suitable for guiding a paper from a heat-fixing device in the paper conveying passage to outside the housing of a copying machine.

Figure 1:
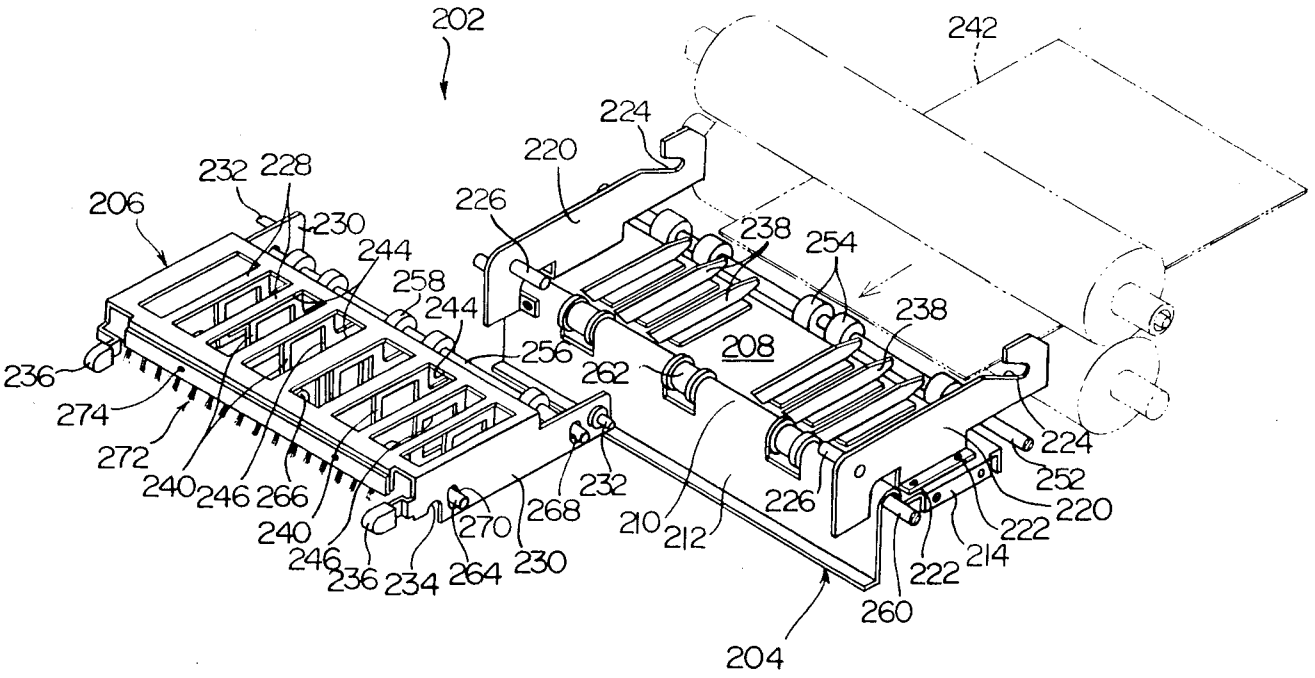
FIG. 1 is an exploded perspective view showing one embodiment of the paper guiding device of the present invention, in which the upper guide plate is removed and separated from the lower guide plate.
Figure 2:
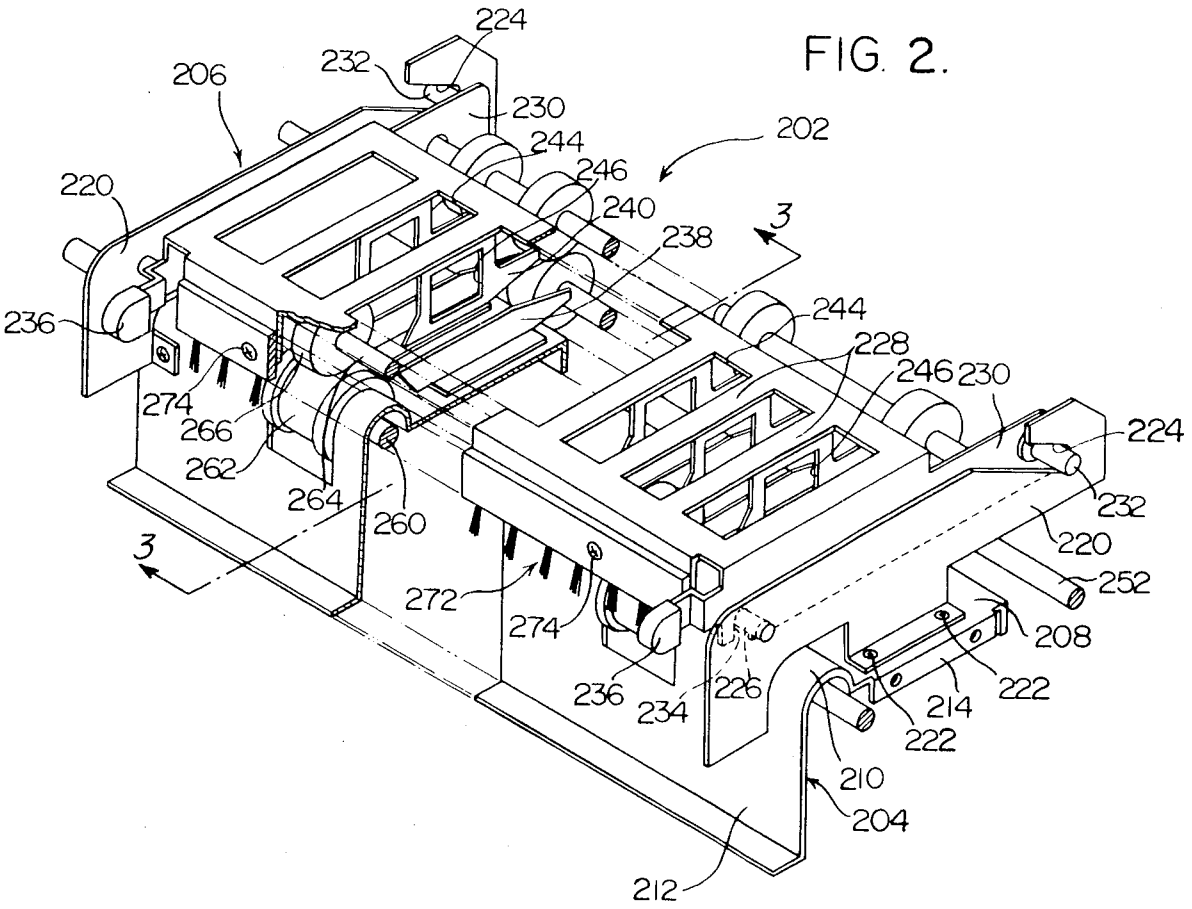
FIG. 2 is a perspective view of the guiding device shown in FIG. 1, in which the upper guide plate is mounted in place on the lower guide plate.
Figure 3:
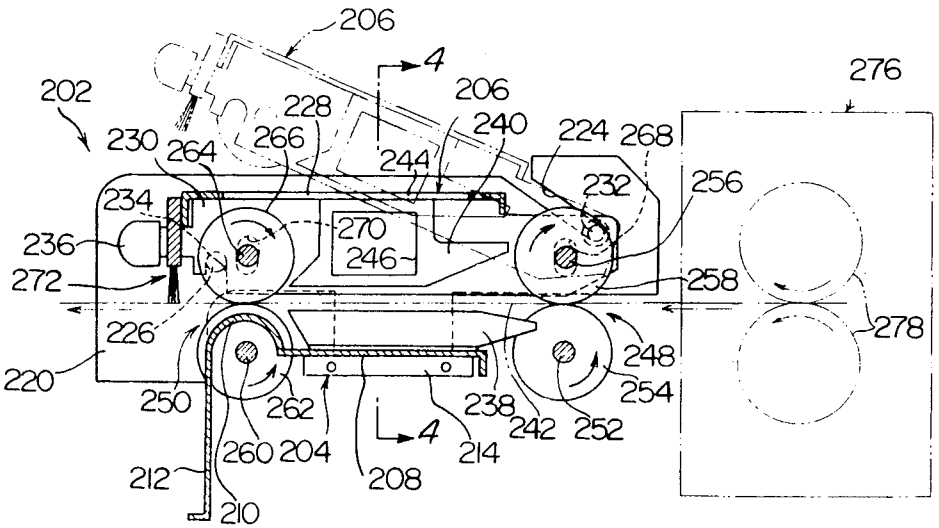
FIG. 3 is a sectional view taken along line 3—3 of FIG. 2.
Figure 4:
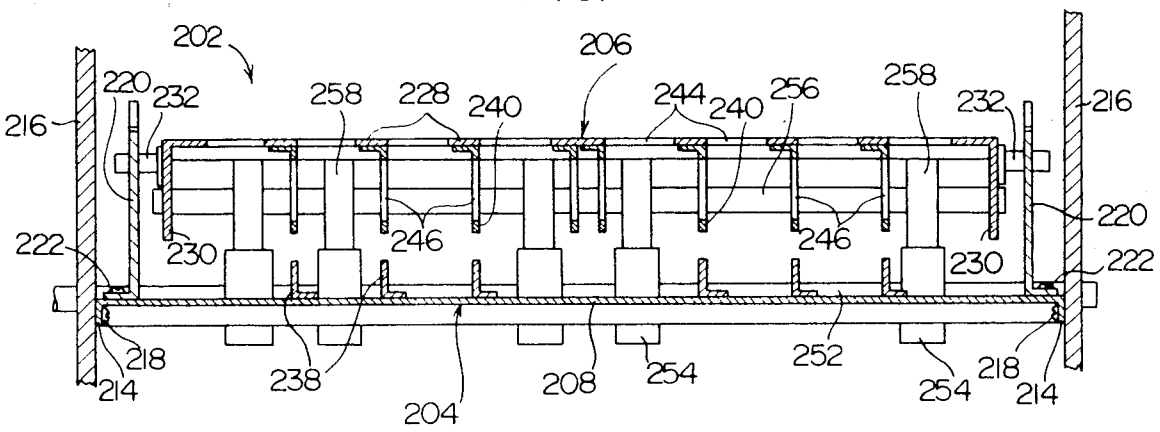
FIG. 4 is a sectional view taken along line 4—4 of FIG. 3.

Referring to FIGS. 1 to 3, the illustrated paper guiding device constructed in accordance with this invention, shown generally at 202, includes a lower guide plate 204 and an upper guide plate 206. It is easily understood from FIGS. 1 and 3 that the lower guide plate 204 in the illustrated embodiment has a main flat portion 208, a curved portion 210 following the downstream end (the left end in FIG. 10) of the main flat portion 208, and an upstanding portion 212 extending downwardly from the curved portion 210. A downwardly extending hanging portion 214 is formed integrally at each side edge of the main flat portion 208. The lower guide plate 204 is fixed in position to the housing of a copying machine by keying the hanging portion 214 by means of a setscrew 218 to the inner surface of each of a pair of upstanding partitioning plates 216 disposed laterally in spaced-apart relationship within the housing of the copying machine, as shown in FIG. 4. To the upper sides of the two opposite side edges of the main flat portion 208 of the lower guide plate 204 are respectively keyed, by means of setscrews 222, side plates 220 which extend substantially perpendicularly upwardly from the upper sides. In the upstream end portions (the right end portion in FIG. 3) of the side plates 220, elangated oblique groove-like notches 224 are formed which extend downwardly and inclinedly in the upstream direction from the upper edges of the side plates 220. Inwardly projecting pins 226 are firmly set respectively at the downstream ends portions (i.e., the left end portions in FIG. 3) of the side plates 220.

As is readily seen from FIGS. 1 and 3, the upper guide plate 206 has a main flat portion 228, and at the opposite side edges of the main flat portion 228 there are respectively formed as an integral unit side plates 230 which extend downwardly therefrom substantially perpendicularly. Outwardly projecting pins 232 are firmly set respectively at the upstream end portions (i.e., the right end portions in FIG. 3) of the side plates 230. Furthermore, the downstream ends (i.e., the left end portions in FIG. 3) of the side plates 230 have respectively formed therein groove-like notches 234 which extend upwardly from the lower edges of the side plates 230. Grip portions 236 projecting in the downstream directions are also respectively formed in the downsteam ends of the side plates 230. It will be readily appreciated from FIGS. 2 and 3 that the upper guide plate 206 described above can be detachably mounted in position on the lower guide plate 204 by operating the aforesaid grip portions 236 so as to position the upper guide plates 206 above the lower guide plate 204 with its side plates 230 being interposed between the side plates 220 of the lower guide plate 204, then moving the upstream end portions of the side plates 230 downwardly in the upstream direction to insert the pins 232 in the notches 224 formed in the upstream end portions of the side plates 220 of the lower guide plate 204, and thereafter moving the downstream end portions of the side plates 230 downwardly to bring the notches 234 into engagement with the pins 226 firmly set at the downstream end portions of the side plates 220 of the lower guide plate 204.

It is important that in the paper guiding device constructed in accordance with this invention, a plurality of rising pieces 238 should be provided laterally in spaced-apart relationship on the upper side of the main flat portion 208 of the lower guide plate 204. The said rising pieces 208 extend upwardly from the upper side of the main flat portion 208 in the moving direction of a copying paper (to the left and right in FIG. 3). Corresponding to these rising pieces 208, the lower side of the main flat portion 228 of the upper guide plate 206 should have formed thereon a plurality of hanging pieces 240 which are disposed laterally in spaced-apart relationship and extend downwardly from the lower side of the main flat portion 228 in the moving direction of the copying paper.

As is readily seen from FIGS. 1 and 4, six rising pieces 238 are provided laterally at suitable intervals on the upper side of the main flat portion 208 of the lower guide plate 204. The rising pieces 238 are fixed in position to the upper side of the main flat portion 208 by, for example, bonding the base portions of these rising pieces to the upper side of the main flat portion 208. The rising pieces 238 extend upwardly from the upper side of the main flat portion 208 substantially perpendicularly over a predetermined range in the moving direction of the copying paper (i.e., to the right and left in FIG. 3). On the other hand, eight hanging pieces 240 are disposed laterally at suitable intervals on the lower side of the main flat portion 228 of the upper guide plate 206. The hanging pieces 240 are fixed in position to the lower side of the main flat portion 228 by, for example, bonding their base portions to the lower side of the main flat portion 228. These hanging pieces 240 extend downwardly from the underside of the main flat portion 228 substantially perpendicularly over a predetermined range in the moving direction of the copying paper (i.e., to the left and right in FIG. 3). As FIGS. 3 and 4 clearly show, the rising pieces 238 and the hanging pieces 240 cooperate with each other to define a paper moving passage therebetween. Specifically, the upper edges of the rising pieces 238 cooperate with the lower edges of the hanging pieces 240 to define a path of paper movement therebetween, and a paper 242 (see FIGS. 1 and 3) moving through the paper guiding device 202 is guided by the upper edges of the rising pieces 238 and the lower edges of the hanging pieces 240. Preferably, as is clearly shown in FIG. 3, the upstream end portions (i.e., the right end portions in FIG. 3) of the upper edges of the rising pieces 238 are inclined downwardly in the upstream direction, and the upstream end portions of the lower edges of the hanging pieces 240 are inclined upwardly in the upstream direction, so that the copying paper 242 (see FIGS. 1 and 3) advancing between the upper edges of the rising pieces 238 and the lower edges of the hanging pieces 240 is surely and easily guided by these rising and hanging pieces. Although in the illustrated embodiment, the rising pieces 238 are formed separately from the main flat portion 208 of the lower guide plate 204 and fixed to the upper side of the main flat portion 208, and the hanging pieces 240 are likewise formed separately from the main flat portion 228 of the upper guide plate 206 and fixed to the lower side of the main flat portion 228, it is possible, if desired, to form the rising pieces 238 integrally with the main flat portion 208 as a unit and to form the hanging pieces 240 integrally with the main flat portion 228 as a unit.

It is important also that in the paper guiding device 202 constructed in accordance with this invention, openings 244 should be formed in the main flat portion 228 of the upper guide plate 206.

In the illustrated embodiment, eight rectangular openings 244 in total are formed in the main flat portion 228 of the upper guide plate 206 between the hanging pieces 240 and between the hanging pieces 240 and the side plates 230. Preferably, these openings 244 are as large as possible so long as they do not affect the rigidity and strength of the upper guide plate 206, the bonding of the hanging pieces 240 to the lower side of the main flat portion 228, etc. It is also preferred that a rectangular opening 246 be formed in each of the hanging pieces 240 themselves. Such openings 246 are also preferably as large as possible so long as they do not affect the rigidity and strength of the hanging pieces 240, etc.

The paper guiding device 202 shown in the drawings further comprises a delivery roller unit 248 disposed upstream (on the right in FIG. 3) of the paper moving passage defined by the upper edges of the rising pieces 238 and the lower edges of the hanging pieces 240, and a discharge roller unit 250 disposed downstream (on the left in FIG. 3) of the paper moving passage, as shown clearly in FIG. 3. The delivery roller unit 248 is comprised of a plurality (5 in the drawing) of driven rollers 254 mounted on a driven shaft 252 at suitable intervals in the lateral direction and a plurality (5 in the drawing) of follower rollers 258 mounted on a follower shaft 256 correspondingly to the driven rollers 254. Likewise, the discharge roller unit 250 is comprised of a plurality (3 in the drawing) of driven rollers 262 mounted on a driven shaft 260 at suitable intervals in the lateral direction and a plurality (3 in the drawing) of follower rollers 266 mounted on a follower shaft 264 correspondingly to the driven rollers 262. The driven shaft 260 of the discharge roller unit 250 is positioned below the curved portion 210 of the lower guide plate 204, but as can be easily understood from FIG. 8, the driven rollers 262 mounted on the driven shaft 260 project upwardly through cuts formed in the curved portion 210. The driven shaft 252 of the delivery roller unit 248 and the driven shaft 260 of the discharge roller unit 250 are rotatably supported on the pair of upstanding partitioning plates 216 (FIG. 4) disposed within the housing of the copying machine. On the other hand, the follower shaft 256 of the delivery roller unit 248 and the follower shaft 264 of the discharge roller unit 250 are respectively inserted rotatably for free up-and-down movement in narrow slots 268 and 270 extending in the up-and-down direction and formed on the side plates 230 disposed on the opposite side edges of the upper guide plate 206. Accordingly, the follower shaft 256 of the delivery roller unit 248 and the follower rollers 258 mounted on it and the follower shaft 264 of the discharge roller unit 250 and the follower rollers 266 mounted on it are biased downwardly by their own weights. As a result, the follower rollers 258 of the delivery roller unit 248 are brought into abutment against the driven rollers 254, and the follower rollers 266 of the discharge roller unit 250 are brought into abutment against driven rollers 262. If required, the follower shaft 256 of the delivery roller unit 248 and the follower shaft 264 of the discharge roller unit 250 may be elastically biased downwardly by suitable spring members (not shown). The driven shaft 252 and the driven shaft 260 are drivingly connected to a suitable driving source (not shown) such as an electric motor through a suitable power transmission means (not shown), and the delivery roller unit 248 and the discharge roller unit 250 are rotated in the direction of an arrow in FIG. 10 by the action of the driving source.

In the illustrated paper guiding device 202, a charge-eliminating brush member 272 known per se is fastened by means of a setscrew 274 to the downstream end (i.e., the left end in FIG. 10) of the upper guide plate 206. The lower end of the charge-eliminating brush member 272 contacts or approaches the surface of the paper 242 (FIGS. 8 and 10) discharged from the paper guiding device 202 by the action of the discharge roller unit 250, thereby to remove the residual charge from the paper 242.

The operation and result of the paper guiding device 202 of the invention described hereinabove will now be stated.

The paper guiding device 202 constructed in accordance with this invention is suitably used for guiding the paper 242 (FIGS. 8 and 10) discharged from a heat-fixing device 276 and conducting it to outside the housing of the copying machine, although its function is not limited to this feature. For this purpose, the paper guiding device 202 is provided adjacent to, and downstream of, the heat-fixing device 276 (FIG. 10). The heat-fixing device 276 (FIG. 10), for example, includes a pair of heat-fixing rollers 278 (FIGS. 8 and 10) at least one of which is adapted to be heated by a suitable heat source (not shown) such as an electric resistance heating wire provided in its interior. By the action of such a pair of heat-fixing rollers 278, the copying paper 242 is slightly pressed to fix the toner image formed on the paper. As can be easily understood from FIG. 10, the paper 242 discharged from the heat-fixing device 276 by the feeding action of the heat-fixing rollers 278 rotated in the direction of an arrow in FIG. 10 is nipped by the delivery roller unit 248 of the paper guiding device 202 and sent to the paper guiding device 202 by the delivering action of the delivery roller unit 248. Then, the paper 242 is moved through the paper moving passage defined by the upper edges of the rising pieces 238 and the lower edges of the hanging pieces 240. Thereafter, the paper 242 is carried away from the paper guiding device 202 by the discharging action of the discharge roller unit 250, and then discharged into a receiving tray (not shown) outside the housing of the copying machine through a discharge opening (not shown) formed on the end wall of the housing.

In the heat-fixing device 276, the paper 242 is heated to a considerably high temperature by the heating action of the pair of heat-fixing rollers 278, and therefore, the paper 242 to be introduced into the paper guiding device 202 is at a considerably high temperature. When the paper 242 at such a high temperature enters the space between the lower guide plate 204 and the upper guide plate 206 of the paper guiding device 202, the space is heated by the heat dissipated from the paper 242. Since the outside of the paper guiding device 202 is generally kept at room temperature or a temperature close to it, dews tend to form on the upper side of the main flat portion 208 of the lower guide plate 204, the lower side of the main flat portion 228 of the upper guide plate 206, etc. However, because in the paper guiding device 202 of the invention, the openings 244 are formed in the main flat portion 228 and the openings 246 are also formed in the hanging pieces 240, the heat dissipated from the paper 242 passed between the lower guide plate 204 and the upper guide plate 206 is effectively dissipated out of the paper guiding device 202 through these openings 246 and 244, and consequently, the dew formation on the upper surface of the main flat portion 208, the under surface of the main flat portion 228, etc. can be effectively prevented. In addition, should such dew formation occur in the main flat portions 208 and 228, etc., the dews are not likely to adhere to the paper 242 because the paper 242 passing between the lower guide plate 204 and the upper guide plate 206 advances through the paper moving passage defined by the upper edges of the rising pieces 238 and the lower edges of the hanging pieces 240, and makes contact only with very limited areas of the upper edges of the rising pieces 238 and the lower edges of the hanging pieces 240. Consequently, no deterioration due to the adhesion of dews occurs in, the paper 242 itself or the toner image formed on it, nor is there paper jamming as a result of the smooth movement of the paper 242 being hampered by the dew formation. In more detail, when relatively large dew drops form on the upper side of the main flat portion 208 of the lower guide plate 204, or the side surfaces of the rising pieces 238, these dew drops are not likely to adhere to the paper 242. But when relatively large dew drops form on the underside of the main flat portion 228 of the upper guide plate 206 or on the side surfaces of the hanging pieces 240, these dew drops are likely to adhere to the paper 242 advancing between the lower guide plate 204 and the upper guide plate 206. According to the paper guiding device 202 constructed by this invention, the aforesaid relatively large dew drops do not form on the underside of the main flat portion 228 or on the hanging pieces 240 because openings are formed both on the main flat portion 228 and on the hanging pieces 240 to greatly reduce the heat capacity of the main flat portion 228 and the hanging pieces 240 and the actual areas of the underside of the main flat portion 228 and the side surfaces of the hanging pieces 240 on which dew could form are markedly decreased. If desired, openings may also be provided in the main flat portion 208 of the lower guide plate 204 and/or the rising pieces 238 to dissipate the heat more effectively from the space between the lower guide plate 204 and the upper guide plate 206 to outside the paper guiding device 202 and thus to further reduce the likelihood of dew formation on the upper side of the main flat portion 208 of the lower guide plate 204 and/or the side surfaces of the rising pieces 238.

What we claim is:

1. In an improved copying paper guiding device including, in opposition, a lower guide plate having a main flat portion and an upper guide plate having a main flat portion, the improvement comprising:

a plurality of rising pieces having top edges and being laterally spaced-apart upon the upper side of the main flat portion of the lower guide plate, said rising pieces rising above the lower guide plate and extending in the direction of movement of copying paper being guided through the improved guiding device; and a plurality of hanging pieces having lower edges and being laterally spaced-apart on the lower side of the main flat portion of the upper guide plate, said hanging pieces hanging from the upper guide plate and extending in said direction of movement of copying paper;

said top edges of said rising pieces and said lower edges of said hanging pieces defining a path of movement of the copying paper through the improved guiding device, each of said top edges and said lower edges having minimal contact with the copying paper during movement along said path; and said upper guide plate main flat portion having a plurality of openings extending therethrough for dissipating heat from the copying paper away from the paper and the improved paper guide device; and each of said hanging pieces having an opening extending therethrough for dissipating heat from the copying paper away from the paper and the improved guiding device;

said top edges of said rising pieces, said lower edges of said hanging pieces and said heat dissipating openings through the main flat portion of the upper guide plate and through each of said hanging pieces substantially preventing accumulation of moisture on the copying paper and on the improved copying paper guiding device.

2. The device of claim 1 wherein the upper guide plate is detachably mounted on the lower guide plate.

3. The device of claim 2 wherein side plates are disposed respectively at both side edge portions of each of the main flat portion of the lower guide plate and the main flat portion of the upper guide plate, and the upper guide plate is detachably mounted on the lower guide plate by bringing a pin and a notch provided respectively at an upstream end portion and a downstream end portion of each of the side plates at both side edge portions of the upper guide plate into engagement with a notch and a pin provided respectively at an upstream end portion and a downstream end portion of each of the side plates at both side edge portions of the lower guide plate.

* * * * *